United States Patent [19]

Mutchler

[11] Patent Number: 5,065,736

[45] Date of Patent: Nov. 19, 1991

[54] AIR HEATING APPARATUS AND METHOD OF HEATING AN AIR STREAM

[75] Inventor: Paul A. Mutchler, University, Mo.

[73] Assignee: Engineered Air Systems, Inc., St. Louis, Mo.

[21] Appl. No.: 649,429

[22] Filed: Feb. 1, 1991

[51] Int. Cl.[5] ..... F24H 3/02

[52] U.S. Cl. ..... 126/110 B; 126/110 C; 126/116 R

[58] Field of Search ..... 126/99 A, 99 R, 110 R, 126/110 B, 85 R, 110 C, 116 R, 104 A, 110 D, 91 R, 91 A, 112, 84, 116 A; 432/223

[56] References Cited

U.S. PATENT DOCUMENTS

| | | | |
|---|---|---|---|
| 585,792 | 7/1897 | Russell | 431/166 |
| 615,445 | 12/1898 | Gearing | 431/190 |
| 741,504 | 10/1903 | Kemp | 431/175 |
| 2,440,491 | 4/1948 | Schwander | 431/263 |
| 2,464,791 | 3/1949 | Bonvillian | 431/173 |
| 4,729,365 | 3/1988 | Mutchler | 126/110 B |

FOREIGN PATENT DOCUMENTS

| | | | |
|---|---|---|---|
| 875975 | 8/1961 | United Kingdom | 126/110 B |

*Primary Examiner*—James C. Yeung

*Attorney, Agent, or Firm*—Polster, Polster & Lucchesi

[57] ABSTRACT

An improved air heating apparatus and method of heating an air stream wherein the heating arrangement includes a heater housing with a combustion drum having a burner at one end thereof, the drum being disposed in spaced relation in the housing to extend longitudinally along the length thereof, a heat exchanger longitudinally extending in the space between the combustion drum and housing to receive combustion products from the combustion drum, an air stream blower positioned to pass an air stream over the heat exchanger in the space between housing and drum and to pass air from opposed ends of the combustion drum including the burner at one end to promote an extended burner flame substantially along the combustion drum length.

16 Claims, 1 Drawing Sheet

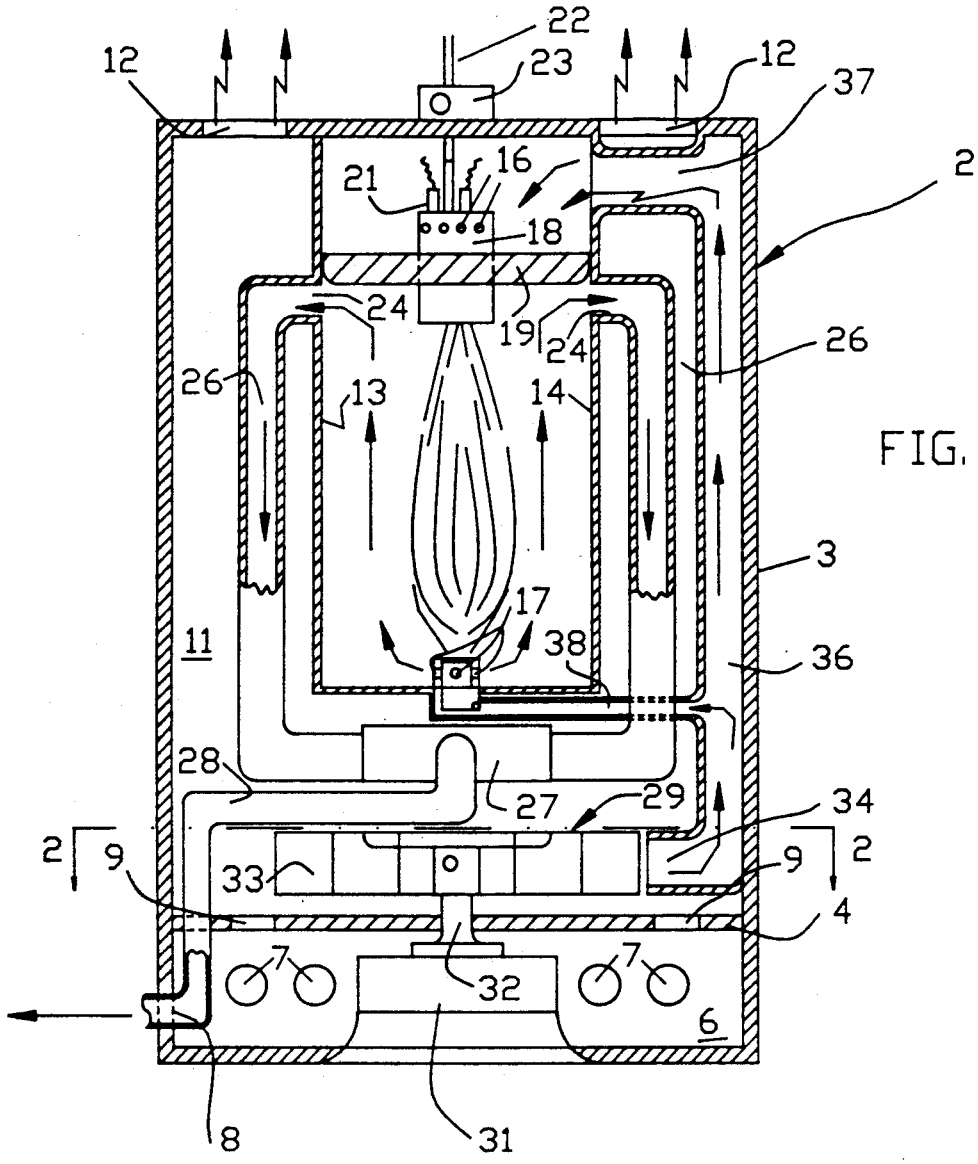
FIG. 1
FIG. 2
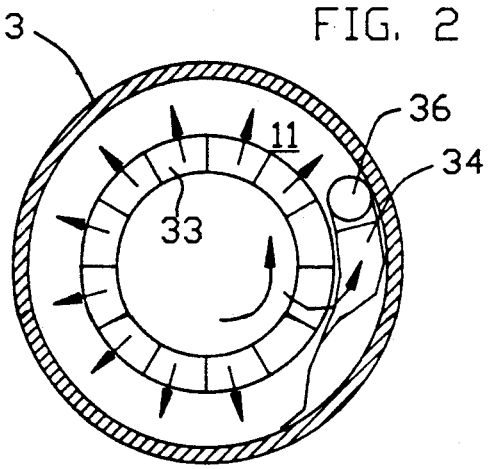
FIG. 3
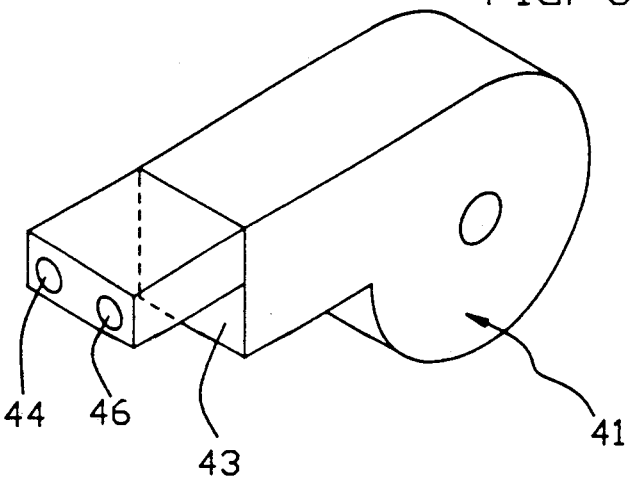

AIR HEATING APPARATUS AND METHOD OF HEATING AN AIR STREAM

BACKGROUND OF THE INVENTION

The present invention relates to an apparatus and method for heating air and more particularly to an improved arrangement for indirect fired air heating with portable structure uniquely suitable to heat personnel and equipment under field conditions.

In the fluid heating art, it has been generally known for a number of years to deliver combustion air from several locations in a combustion chamber to facilitate combustion within such chamber, attention being directed to the long since expired U.S. Pat. Nos. 585,792, issued to M. T. Russell on July 6, 1897; to 615,445, issued to C. M. Gearing on Dec. 6, 1898; and, to 741,504, issued to W. Kemp on Oct. 13, 1903. All three of these expired patents teach such principle of multiple air introduction into a furnace combustion chamber as being old in the art. Attention further is directed to more recent U.S. Pat. Nos. 2,440,491, issued to E. F. Schwander on Apr. 27, 1948 and 2,464,791, issued to C. A. Bonvillian et al on Mar. 22, 1949, both patents teaching introducing air along several points of a combustion chamber with the Schwander patent introducing air from opposed combustion chamber points and the Bonvillian patent suggesting secondary air be delivered along elongated openings of a chamber under any pressure. This broad principle of utilizing primary and opposed secondary air ducts in a combustion chamber has even been employed in the hot water boiler art with known General Electric type boilers using such principle to heat water in a shell type water jacket surrounding a combustion chamber. In these aforenoted arrangements, little attention was given to the exhaust products emitted from the fuel burning combustion chamber with such products generally being passed to ambient. More recently, prior art arrangements have been utilized wherein exhaust products emitted from a combustion drum are passed through a heat exchanger extending in an area between the drum and the outer housing in order to capture additional heat in an air stream to be heated in such area, attention being directed to unexpired U.S. Pat. No. 4,729,365, issued to Paul A. Mutchler on Mar. 8, 1988.

The present invention recognizing the heating efficiency accomplished by utilizing exhaust emissions to further heat an air stream as taught by U.S. Pat. No. 4,729,365, employs such known principle in combination with the known principle of delivering combustion supporting air from several locations in a combustion chamber in a novel arrangement that results in even more efficient air stream heating by intensifying the heat to the air stream along an extended area covering a substantial portion of the length of the heat emitting combustion drum and the exhaust products heat exchanger functionally associated with such combustion drum.

In accordance with the present invention, a novel air stream heating arrangement is provided which, recognizing known principles in the heating art, combines these principles in an arrangement which provides a unique method for efficiently heating an air stream with a minimum of steps and an apparatus which can be manufactured and assembled with a minimum of parts and ducting to provide an improved air heater which is light in weight for ready portability and which can be readily and stably disposed in the confines to be heated to occupy a minimum of space for easy usage under varying field conditions. Moreover, the present invention allows the heating of comparatively large volumes of air over large ambient temperature ranges by both radiation and convection with minimum power inputs and with minimum operating noise levels. In addition, the present invention provides for ready access to the burner assembly with minimum carbon production on combustion drum walls due to the nature of combustion and exhaust gas flows with exhaust gases being relatively free of smoke and with emission of such exhaust gases from the confined areas to be heated at ground level.

Various other features of the present invention will become obvious to one skilled in the art upon reading the disclosure set forth herein.

BRIEF SUMMARY OF THE INVENTION

More particularly the present invention provides an improved air heating apparatus comprising: a longitudinally extending outer housing having spaced air inlet and air outlet means; a combustion drum disposed within the outer housing, the drum including air intake openings at opposed ends thereof for introduction of combustion air through such opposed ends, the drum being sized and shaped to define a longitudinally extending flow-through passage between the drum and outer housing; burner means disposed within the drum in communication with the combustion air inlet openings at opposed ends of the drum to enhance combustibility within the combustion drum creating a narrow flame centrally along the substantial length of the drum with combustion gases flowing along the drum wall; at least one combustion gas outlet in the drum; at least one combustion gas outlet in the outer housing; heat exchange means disposed to extend along the flow-through passage defined by the spaced drum and outer housing along the substantial length of the drum, the heat exchange means being communicatively connected to both the combustion gas outlet in the drum and the combustion gas outlet in the outer housing; and, blower means cooperatively positioned with respect to the outer housing to move air through the openings at opposed ends of the combustion drum to support combustibility with the narrow flame of combustion extending along the substantial length of the drum, the blower means further moving air between the drum and outer housing over the substantial length of the heat exchanger to efficiently warm the moving air by the substantial length of the heat exchanger means and the substantial length of the outer surface of the combustion drum. In addition the present invention provides a unique method of heating an air stream in a confined main zone having spaced air inlet and outlet means between which an air stream to be heated is passed comprising: passing a minor portion of an air stream to a first confined subzone disposed in spaced relation within the main zone through opposite extremities of the first confined subzone; passing a fuel-air mixture to the first confined subzone and igniting the same to provide a narrow flame extending along the substantial central length of the first confined subzone; passing the products of combustion along the outer face of and from the first confined subzone to a second confined subzone disposed within the main zone in spaced relation from the first confined subzone to define a third confined subzone therebetween, and, passing the major portion of the air stream through the third confined subzone to be heated along the substantial length thereof by convection and radiation before passing through the main air outlet means.

It is to be understood that various changes can be made by one skilled in the art in one or more of the several parts of the inventive apparatus and one or more of the several steps of the inventive method disclosed herein without departing from the scope or spirit of the present invention. For example, more than one air stream blower and type can be used and the location, positioning and configuration of the heat exchanger can be varied.

BRIEF DESCRIPTION OF THE DRAWINGS

Referring to the drawings which disclose one advantageous embodiment of the present invention and a modified centrifugal air stream blower which can be employed:

FIG. 1 is a schematic, partially cross-sectional view of a unique heater arrangement which can be employed to carry out the present invention;

FIG. 2 is a somewhat reduced plan view of the radial fan blower scroll and conduct assembly taken in a plane through line 2—2 of FIG. 1; and, FIG. 3 is an enlarged isometric view of a unique centrifugal blower arrangement which can be employed with the heater of FIG. 1 in place of the radial fan blower of FIGS. 1 and 2.

DETAILED DESCRIPTION OF THE DRAWINGS

Referring to FIG. 1 of the drawings, an improved air heater apparatus 2 is disclosed in partial cross-section, incorporating some of the principal features of the present invention.

Heater apparatus 2 can include a longitudinally extending, vertically disposed outer cylindrical housing 3 which can be made from any one of a number of suitable materials, such as a basic steel with an aluminum coating suitable to keep outer surface temperatures below 140 F. to avoid burns. A typical cylindrical housing configuration would be one of approximately sixteen inches (16") diameter and of approximately three feet (3') height. Advantageously, the housing 3, including the several parts disposed therein and described hereinafter, will be light in weight (approximately sixty pounds and can be provided with suitable lifting handles [not shown]). A partition plate 4 can be provided to extend across the lower portion of housing 3 to provide an air inlet plenum 6 having a suitable number of spaced air inlets 7 in the lower housing wall which lower wall also includes a lower exhaust outlet 8. It is to understood that partition plate 4 can be appropriately vented with a suitable number of vent apertures, as at 9, to permit air to pass from air inlet plenum 6 to main annular plenum 11 (described more fully hereinafter) which main annular plenum 11 communicates with a suitable number of upper air outlets 12 positioned in the top wall of housing 3.

Vertically disposed in housing 3 is a longitudinally extending, cylindrical combustion drum 13. Drum 13, which also can be made of a suitable light weight, fire proof metallic material, is sized to define the aforedescribed main annular plenum 11 which longitudinally extends between the cylindrical wall of combustion drum 13 and the inner wall of outer housing 3 with plenum 11 being in communication, through vents 9 in partition 4, with lower spaced air inlets 7 for air inlet plenum 6 and ultimately with upper spaced air outlets 12. Combustion drum 13 serves to define a combustion plenum 14 which includes opposed upper and lower air inlet openings 16 and 17 respectively at opposed ends of plenum 14 defined by the wall of drum 13. It is to be noted that upper air inlets 16 are provided in spaced relation along the periphery of burner 18 which extends in vertical longitudinal fashion through the top of removable top wall or cover plate 19 of combustion drum 13 with the central axis of burner 18 aligned with the central axis of combustion drum 13 and with opposed aforedescribed upper and lower air inlets 16 and 17 respectively being substantially in alignment around such central axis of the drum. Suitable electrodes 21 are mounted at the closed end of burner 18 along either side of fuel nozzle 22 which extends through fuel control and reset box 23. With this burner arrangement, including the opposed air inlets 16, a narrow flame is created to extend from burner 18 along the central axis of combustion plenum 14 of combustion drum 13. This narrow flame extends along the substantial central length of plenum 14 of drum 13, advantageously in the range of eighty to one hundred per cent (80–100%) of such length. The products of combustion from such flame are caused to flow upwardly in surrounding relation to the narrow flame from the closed bottom of combustion drum 13 (except for lower air inlets 17) along the peripheral walls of combustion drum 13. These products of combustion which flow in plenum 14 around the long narrow flame and along the inner peripheral walls of combustion drum 13 have the heat thereof radiating through the wall into main annular plenum 11. It is to be noted that the upwardly flowing hot exhaust gases, enhanced in upward flow by their heat content, also serve to minimize undesirable carbon deposits along the inner peripheral wall surface of combustion drum 13. The hot exhaust gases exiting through exhaust gas outlets 24 in drum 13 are conducted downwardly through a plurality of spaced heat exchanger tubes 26 extending longitudinally in spaced relation from the inner wall of housing 3 and the outer wall of combustion drum 13 in the main annular plenum 11 formed therebetween. One corresponding end of each tube is fastened to an exhaust gas outlet 24 at the upper end of combustion drum 13 and the opposite corresponding lower end is connected to an annular outlet manifold 27 positioned below the closed lower end of drum 13. A suitable exhaust conduit 28, projects through partition plate 4 to connect exhaust manifold 27 with the aforedescribed lower exhaust outlet 8 in outer housing 3. Heat exchange tubes 26, manifold 27 and exhaust conduit 28 can be made from any one of several known materials. Advantageously, a base conducting metal is used for spaced heat exchange tubes 26, only three or four of such tubes being required to remove the comparatively small amounts of exhaust gases from combustion drum plenum 14 of drum 13.

To move an air stream through main annular plenum 11 from air inlets 7 to air outlets 12 and from opposed air inlets 16 and 17 in combustion drum 13, a blower assembly 29 is provided in the lower portion of housing 3. This blower assembly 29 can include a pancake shaped electric motor 31 positioned in flat horizontal position in air inlet plenum 6 to add to the stability of housing 3, the partition 4 and the housing walls serving to reduce the noise of this motor. Motor 31 can be connected through vertically disposed drive shaft 32 extending through partition wall 4 to a flat radial fan blower 33 horizontally spaced above partition 4 in the lower portion of housing 3. As can be seen in FIGS. 1 and 2 of the drawings, radial fan blower 33 communicates directly with main annular plenum 11 and with a radial take off duct 34 connected to vertical conduit riser 36. Riser 36 is fastened to the wall of housing 3 and is connected to opposed upper and lower air inlets 16 and 17 in combustion drum 13. In this regard, suitable upper and lower branch conduit 37 and 38 are provided to connect vertical riser conduit 36 with the opposed upper and lower air inlets 16 and 17 respectively in drum 13. Advantageously, a minor portion of approximately ten to twenty-five percent (10–25%) by volume of the air stream produced by radial blower fan 33 is fed to the take-off duct 34 and ultimately to opposed air inlets 16 and 17. The remaining major portion of the air stream or seventy-five to ninety per cent (75–90%) by volume is fed to main annular plenum 11 to be heated primarily by radiation and incidentally by convection before passing through air outlets 12 to heat a personnel or equipment enclosure, such as, a tent or housing shelter. It is to be noted, that since both the heated air stream and hot exhaust gases are initially caused to move upwardly in the direction of natural heat rise in the structure disclosed, a minimum of electrical power is required for motor 31. Along with this minimum of required operating power and with the insulating partitions aforedescribed, it is possible to maintain a minimum noise level, advantageously less than fifty-five (55) decibels in the surrounding plenum or area to be heated.

Referring to FIG. 3 of the drawings, a unique centrifugal blower 41 is disclosed which can be utilized in heater assembly 2 in place of the radial fan blower 33. Specifically, centrifugal blower 41 can be arranged to include a main, centrally located, direct outlet 43 to move a major portion of the air stream through main annular plenum 11. Direct outlets 44 and 46 can be provided along the outer periphery of centrifugal blower 41. These outlets can be connected by suitable conduits not shown to the upper and lower air inlets 16 and 17 of combustion drum 13. Since these outlets are positioned along the outer periphery of centrifugal blower 41, the air streams from outlets 44 and 46 are greater in air pressure than from outlet 43, this increased pressure serving to enhance exhaust gas flow in combustion drum 13, further minimizing carbon deposit along the walls of drum 13. At the same time, the lower main pressure stream from outlet 43 serves to maximize residence time as the major portion of the air stream moves through main annular plenum 11 of heater 2. It is to be understood that it also would be possible to utilize two blowers positioned at opposite extremities of drum 13, with one blower for each of the upper and lower air inlets 16 and 17 and at least one blower communicating with main annular plenum 13.

It further is to be understood that other types of air heaters can be used to carry out the several steps of the novel air heating method of the present invention. This novel method includes the steps of passing an air stream to be heated in a confined main zone having spaced air inlet and outlets between which the air stream is to be passed; moving a minor portion of such air stream to a first confined subzone disposed within the main zone through opposite extremities of the first confined subzone; passing a fuel-air mixture to the first confined subzone and igniting the same to provide a narrow flame extending along the substantial central length of the first confined subzone; passing the products of combustion along the outer face of and from the first confined subzone to a second confined subzone disposed within the main zone in spaced relation from the first confined subzone to define a third confined subzone therebetween; and, passing the remaining major portion of the air stream through such third confined subzone to be heated along the substantial length thereof by radiation and convection before passing through the air outlets of the main zone.

The invention claimed is:

1. An improved air heating apparatus comprising: a longitudinally extending outer housing having spaced air inlet and air outlet means; a combustion drum disposed within said outer housing, said drum including air intake openings at spaced positions relative each other in said drum for introduction of combustion air into said drum through such spaced positions, said drum being sized and shaped to define a longitudinally extending flow-through passage between said drum and said outer housing; burner means disposed within said drum in communication with one of said combustion air inlet openings at said spaced positions in said drum to enhance combustibility within said combustion drum with said introduction of air into said drum through said air intake openings at said spaced positions in said drum, creating a narrow flame extending along the substantial length of said drum with combustion gases flowing along the substantial length of the drum wall to heat said drum wall with at least one combustion as outlet in said drum; at least one combustion gas outlet in said outer housing; heat exchange means disposed to extend along said flowthrough passage defined by said spaced drum and said outer housing along the substantial length of said drum, said heat exchange means being communicatively connected to both said combustion gas outlet in said drum and said combustion gas outlet in said outer housing; and blower means cooperatively positioned with respect to said outer housing to move air through said air intake openings at said spaced positions in said combustion drum to support combustibility with said narrow flame of combustion extending along the substantial length of said drum, said blower means further moving air between said drum and said outer housing over the substantial length of said of heat exchanger to efficiently warm such air by the substantial length of said heat exchanger means and the substantial length of the outer surface of said heated drum wall of said combustion drum.

2. The air heating apparatus of claim 1, said heat exchange means being in spaced relation to both said drum and said outer housing.

3. The air heating apparatus of claim 1, said blower means including two separate blowers positioned at opposed extremities of said combustion drum with at least one blower being in communication with said spaced flow-through passage, said burner means and one end of said combustion drum and the other blower being in communication with the opposite end of said combustion drum.

4. The air heating apparatus of claim 1, said blower means comprising a single blower in communication with said spaced flow through passage and the opposite ends of said combustion drum.

5. The air heating apparatus of claim 1, wherein said outer housing, combustion drum, and burner means are substantially vertically disposed.

6. The air heating apparatus of claim 1, said combustion gas outlets in said combustion drum and said outer housing being adjacent opposed extremities of said combustion drum.

7. The air heating apparatus of claim 1, said air opening in said drum opposite to said air opening communicating with said burner means being centrally aligned with said burner means to enhance the length of said narrow flame emitted from said burner means.

8. The air heating apparatus of claim 1, wherein the narrow flame created along the length of said combustion drum is in the range of eighty (80) to one hundred (100) per cent of the drum length.

9. The air heating apparatus of claim 1, said blower means including a single centrifugal type blower with a pair of conduits directly connected at one of the corresponding ends thereof to adjacently spaced outlets along the outer periphery of said centrifugal blower means and at the other of the corresponding ends thereof to said air openings at opposite ends of said combustion drum with the remainder of said outlet of said blower means communicating with said flow-through passage between said drum and said outer housing to heat an air stream before passing through said air outlet means of said outer housing.

10. The air heating apparatus of claim 1, said blower means including a single radial fan blower with a radial take-off duct and conduit communicatively connected with a minor peripheral portion of said radial fan blower, said conduit further being connected to said air openings at opposed ends of said combustion drum with the remainder of said radial fan blower communicating with said flow-through passage between said drum and said outer housing to heat an air stream before passing through said air outlet means of said outer housing.

11. The air heating apparatus of claim 1, wherein said outer housing, said combustion drum and said burner means are substantially vertically disposed with the outlets and blower so positioned that exhaust gases within said drum and the air between said drum and housing is moved upwardly in a vertical direction.

12. An improved air heating apparatus comprising; a longitudinally extending vertically disposed outer cylindrical housing having spaced lower air inlets; a lower exhaust outlet and spaced upper air outlets; a longitudinally extending, cylindrical combustion drum vertically disposed in said outer housing, said combustion drum being sized to define a longitudinally extending annular flow-through passage between said cylindrical combustion drum and said cylindrical outer housing in communication with said lower spaced air inlets and said upper spaced outlets, said combustion drum including upper and lower air inlet openings at opposed ends thereof for introduction of combustion air into said air inlet openings at said upper and lower opposed ends of said drum; a cylindrical burner communicating with said upper inlets disposed in said combustion drum at the upper end thereof to extend along the central longitudinal axis of said drum in axial alignment with said lower air inlet opening at the opposed lower end of said drum to enhance combustibility within said drum to create a narrow flame extending along the length of said central longitudinal axis of said drum in a range of approximately eighty (80) to one hundred (100) per cent of said drum length; a plurality of combustion gas outlets in said upper end of said drum adjacent to and spaced from said burner disposed at said upper end of said drum; a plurality of spaced heat exchanger tubes extending longitudinally along said combustion drum in said annular flow through passage between and spaced from said housing and drum, one corresponding end of each tube being connected to one of said combustion gas outlets at the upper end of said drum and the opposite corresponding lower end being connected to an annular outlet manifold which is in turned connected to said lower exhaust outlet in said outer cylindrical housing; said exhaust outlet being positioned from that end of said drum opposite said burner; and, a blower assembly to introduce 10–25% by volume of combustion air into said combustion drum upper and lower air openings positioned at opposed ends thereof, and to pass the remaining major volume of air upwardly to be heated through said annular flow-through passage, said assembly including a single radial fan blower with a radial take-off duct and conduit end connected with a minor portion of said radial fan blower to receive 10–25% of the air by volume, said conduit further being connected to said air inlet openings at opposed ends of said combustion drum with the remaining major portion of the air stream from said radial fan blower communicating with said flow-through passage between said drum and said outer housing to heat such air stream before passing through said air outlet means of said outer housing.

13. A method of heating an air stream in a confined main zone having spaced air inlet and outlet means between which an air stream to be heated is passed comprising: passing a minor portion of an air stream to a first confined subzone disposed in spaced relation within said main zone through spaced positions in said first confined subzone; passing a fuel-air mixture to said first confined subzone and igniting the same to provide a narrow flame extending along the substantial central length of said first confined subzone to heat the substantial length of the periphery of said first confined zone; passing the products of combustion along the outer face of and from said first confined subzone to a second confined subzone disposed within said main zone in spaced relation from said first confined subzone and extending along the substantial length of said first confined zone to define a third confined subzone extending along the substantial length therebetween; and, passing the remaining major portion of the air stream through said third confined subzone to be heated along the substantial length thereof by the heated substantial length of said first and second confined zones by radiation and convection before passing through said main air outlet means.

14. The method of heating an air stream of claim 13, wherein said main zone and said first, second and third confined zones therein are arranged to extend in elongated parallel relation.

15. The method of heating an air stream of claim 13, wherein said main air stream is passed in a vertical upward direction in said third subzone from a lower inlet through an upper outlet in counterflow with said products of combustion in said second subzone.

16. The method of heating an air stream of claim 13, wherein a minor portion of an airstream in the range of 16 to 25 per cent by volume is passed through said first and second subzones with the remaining major portion by volume of said air stream being passed through said third subzone.

* * * * *